US006108431A

United States Patent [19]

Bachler

[11] Patent Number: 6,108,431

[45] **Date of Patent: *Aug. 22, 2000**

[54] LOUDNESS LIMITER

[75] Inventor: Herbert Bachler, Meilen, Switzerland

[73] Assignee: Phonak AG, Stafa, Switzerland

[ * ] Notice: This patent issued on a continued prosecution application filed under 37 CFR 1.53(d), and is subject to the twenty year patent term provisions of 35 U.S.C. 154(a)(2).

[21] Appl. No.: 08/720,748

[22] Filed: Oct. 1, 1996

Related U.S. Application Data

[63] Continuation-in-part of application No. 08/640,635, May 1, 1996.

[51] Int. Cl.[7] ..... H04R 25/00

[52] U.S. Cl. ..... 381/312; 381/318; 381/320

[58] Field of Search ..... 381/68, 68.2, 684, 381/98, 99, 100, 101, 102, 103, 60, 104, 105, 106, 107, 108, 109, 312, 320, 321, 57

[56] References Cited

U.S. PATENT DOCUMENTS 4,406,923 9/1983 Burne, III et al. ..... 381/108
4,475,230 10/1984 Fukuyama et al. ..... 381/68
5,278,912 1/1994 Waldhauer ..... 381/106

FOREIGN PATENT DOCUMENTS 237203 9/1987 European Pat. Off. .
661905 7/1995 European Pat. Off. .
9423548 10/1994 WIPO .

OTHER PUBLICATIONS

U.S. application No. 08/640,635, Filed May 1, 1996, Inventors: Bohumir Uvacek et al.

*Primary Examiner*—Huyen Le
*Attorney, Agent, or Firm*—Pearne & Gordon LLP

[57] ABSTRACT

For limiting the signal transmitted to the human ear in dependency on an incoming acoustical signal, there is provided a signal processor, the output of which acts on an output transducer and on a calculator unit which calculates according to a preselected model the psychoacoustical entity loudness of the incoming acoustic signal. The loudness, thus calculated, is compared with a predetermined loudness level (MAL) and according to the result of such comparison, parameters at the processor unit are varied so as to restrict the transmitted loudness on the MAL level.

6 Claims, 2 Drawing Sheets

LOUDNESS LIMITER

This application is a continuation-in-part of U.S. application Ser. No. 08/640,635 filed May 1, 1996.

The present invention is directed to a method for limiting the signal transmitted to the human ear in dependence on an incoming acoustical signal and is further directed to a hearing apparatus which comprises on input acoustical/electric transducer, the output thereof being operationally connected to the input of a signal processor unit with a controllable spectral transfer characteristic, the output of this processor unit being operationally connected to the input of an output transducer for the human ear.

Loudness of n audio signal is a psycho-acoustical entity. Several models have been developed to quantify the loudness which a standard individual will perceive dependent on incoming audio signals. We refer as examples to:

E. Zwicker, "Psychoakustik", Springer Verlag Berlin, Hoch-schultext, 1982;

A. Leijon "Hearing Aid Gain for Loudness-Density Normalization in Cochlear Hearing Losses with Impaired Frequency Resolution", Ear and Hearing, Vol. 12, No. 4, 1990;

EP-0 661 905 of the same applicant as the present application;

H. Dillon, "Compression? Yes, but for low or high frequencies, for low or high intensities, and with what response times?", Ear and Hearing, Vol. 17, No. 4, 1996.

All models used for calculation of loudness perception apply the concept of an auditory filterbank and subdivide an audio signal into spectral bands. In psychoacoustics, these filter-bands are called the critical bands. They provide a constant filter bandwidth on a psychoacoustical frequency scale, normalized to Bark (Swicker) or ERB. (B. Moore "Perceptual consequences of cochlear damage", Oxford Psychology Series 28, Oxford University Press, 1995).

In a first step, the auditory filterbank is performing a transformation of the physical spectrum into a so-called excitation pattern. The excitation pattern, output response of the auditory filterbank, can be calculated for arbitrary signal spectra, procedures are described in the literature (Moore).

In the second step, the loudness provided by the respective cochlear excitation is calculated from the contributions in each critical band, called the specific loudness, and is further integrated or summer over all the bands of the auditory filterbank, yielding the total loudness of the signal spectrum.

The parameters of the loudness model are known and standardised for normal hearing listeners and can be modified for impaired subjects. Accordingly, methods for the measurement of loudness model parameters of individual subjects have been proposed (S. Launder, "Loudness Perception in Listeners with Sensorineural hearing Impairment", Dissertation, Dept. of Physics, University of Oldenburg, Germany, 1995.) With respect to the standard of normal hearing we refer to ISO 226, "Acoustics—normal equal-loudness contours", International Organization for Standardization, Geneva 1987.

Loudness of an audio signal spectrum can be generically expressed by:

$$L(S(f), P) = \sum_{k=1}^{n} L'_k(S_k, P_k)$$

L(P): loudness $L'_k(S_k(f), P_k)$: specific loudness, loudness contribution of the frequency band no. k $P_k$: band specific model parameters $S_k(f)$: the physical spectrum of the signal in band no. k out of the physical spectrum s(f).

P: the entity of $P_k$ parameters

In this literature loudness is often referred to with the symbol N and respectively N' instead of L, L'.

Due to safety and comfort it is known that hearing aids necessitate a system for limiting the power of signals, as especially the sound pressure for electric/acoustical output transducers, which is transmitted to the human ear in dependence on incoming acoustical signals. Even under broader aspect and thus under the aspect of human ear protection in very loud environment, the need of such limiting is evident.

In today's hearing aid technology two limiting techniques are known, namely the so-called "peak clipping (PC)" and the so-called "automatic gain control (AGC)" technique (H. Dillon).

According to the PC technique the transmitted power is clamped to a threshold value. This has obviously the disadvantage that a considerable amount of harmonic distortion occurs as soon as the transmitted signal reaches the clipping level. It is thereby customary at hearing aids of this technique to provide adjustment of the limiting threshold.

According to the AGC technique the transmitted power is measured, compared to an admitted level and according to the result of this comparison the gain of the hearing aid apparatus is adjusted as by feedback control. Thereby, it has further been proposed to divide the transfer characteristics of the hearing aid into distinct spectral bands, setting for each spectral band a specific threshold value and, by AGC, to limit the transmitted power separately in each frequency band.

All these approaches depart from the attempt to limit the power level according to a power limit where hearing becomes uncomfortable or even harmful. Thereby, it is known that human beings do not perceive physical power as especially sound pressure level, but do perceive the psychoacoustic loudness and that especially discomfort is caused by too high loudness.

SUMMARY OF THE INVENTION

Following up this knowledge, it is an object of the present invention to provide a method and an apparatus as was stated above which limits such signal transmitted to the human ear according to human perception of acoustical signals.

Departing from a method as stated above, this object is realized by providing a limiting hearing apparatus which generates from an input acoustical signal an output signal which is transmitted to the human ear with a controllable transfer characteristic;

storing at the apparatus a threshold value;

generating at the apparatus a signal which is dependent on loudness of the signal transmitted to the human ear and reducing loudness of the transmitted signal to the ear by automatically adjusting parameters of the transfer characteristic which determine the loudness of the signal transmitted to the human ear as soon as the signal dependent on loudness of said transmitted signal reaches the threshold value.

In opposition, especially to the approach of AGC, inventively the loudness of a transmitted signal is monitored or modelled as a test entity. This is performed by applying a model calculating the perceived loudness out of a spectrum representing an acoustical signal, and it is this loudness which is compared with a comfort loudness threshold which is standard and/or individually determined by experiments so as to limit the loudness of the transmitted signal. In a preferred embodiment, lowering the loudness is performed by lowering the loudness contributions in all or in a predominant part of the critical bands individually or by equal percentage.

Also, and not limiting the present invention, the invention method is predominantly applied with hearing aid apparatus as the limiting apparatus.

In a further preferred embodiment of the invention method, the spectral transfer characteristic of the apparatus is set or permanently adjusted in dependence on the loudness perceived by an individual carrying the hearing aid and of the reference loudness which would be perceived by a standard individual without hearing aid.

The invention hearing apparatus construed to perform the object as mentioned above comprises a presettable storing unit and a calculating unit with an input operationally connected to the output of the processor unit which calculating unit generates an output signal which is dependent on loudness of an acoustical signal represented by the signal at the input of the output transducer. The output of the presettable storing unit and the output of the calculating unit are operationally connected to respective inputs of a comparing unit, the output of which being operationally connected to adjusting inputs at the signal processor unit, thereby automatically adjusting its transfer characteristic. Thereby, by adjusting the transfer characteristic of the signal processor unit, the resulting loudness as monitored by the calculating unit according to a preselected model is accordingly lowered down to reaching, e.g. in a negative feedback control loop or by iteration, the value as preset in the storing unit which accords to the loudness level of maximum acceptable loudness, MAL.

BRIEF DESCRIPTION OF THE DRAWINGS

The invention and further embodiments will be apparent with reference to the following description and drawings, wherein.

DETAILED DESCRIPTION OF THE PREFERRED EMBODIMENT

Figure 1:
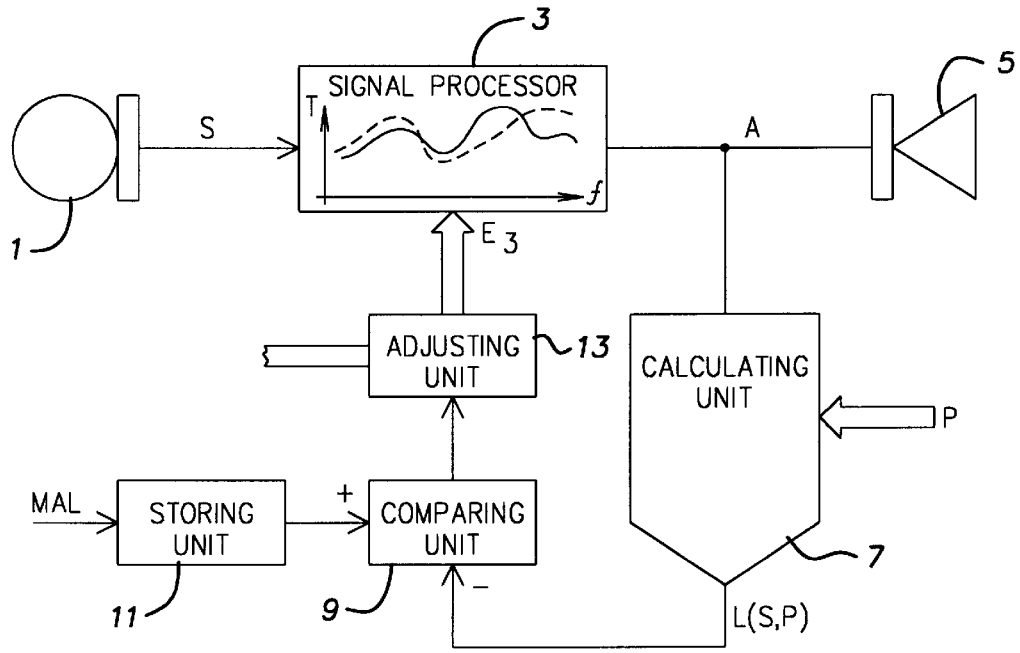
FIG. 1 a highly simplified functional block/signal flow diagram of an inventive limiting apparatus performing the invention method, FIG. 2 a functional block/signal flow diagram of a hearing aid apparatus construed according to the present invention and in today's preferred form, FIG. 3 heuristically the spectrum of a signal at the output of the invention apparatus leading to over-loudness and limited to a loudness below or on MAL.

According to FIG. 1, an inventive limiting apparatus comprises on input acoustical/electrical transducer 1, the output thereof being operationally connected to the input of a processor unit 3, the output of which being operationally connected to an output transducer, as shown to an output electrical/mechanical transducer 5.

The signal processor unit 3 has a transfer characteristic T(f) as a function of frequency f (in Hz, Bark or ERB) which is adjustable at control inputs $R_3$ as examplified with the characteristics in unit-block 3. As will be described later in connection with the preferred embodiment, the transfer function T is preferably formed by a bank of filters e.g. in parallel structure, each filter defining and thus predominantly acting in a specific spectral band, e.g. according to the critical bands of human hearing.

A calculating unit 7 has its input operationally connected to the output of processor unit 3 and calculates loudness L(S,P) of the output signal of unit 3. This unit performs calculation of loudness L following a selected loudness model, as e.g. disclosed in the EP-0 661 905 or in S. Launder, which both references are incorporated with respect to loudness modelling into the present description.

Selected model parameters P are input to the calculation unit 7. The output of the calculation unit 7 representing loudness as a psychoacoustical entity is fed to an input of a comparing unit 9, the other input of which being operationally connected to a storing unit 11 which has been loaded with the MAL-value, be it of an individual or be it as a generic standard safety value. If the loudness L-value as calculated by unit 7 reaches or exceeds the MAL-value, the comparator unit 9 acts on an adjusting unit 13 wherein transfer function control signals applied to $E_3$ are adjusted so as to reduce loudness L(S,P) as modelled by calculation unit 7.

Thus, the actual loudness as transmitted to the human ear and thus perceived is monitored and the signal transferred to the human ear is reduced as soon as the monitored loudness reaches MAL.

Figure 2:
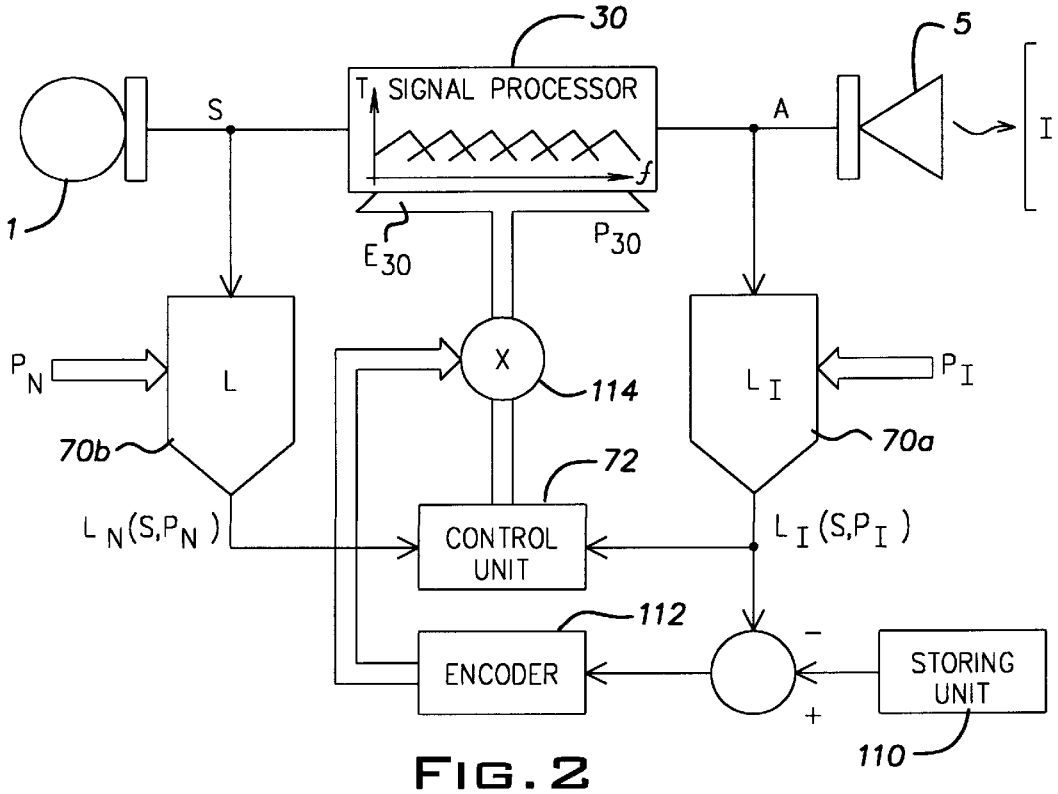

In FIG. 2 a preferred embodiment of the present invention implied preferably in a hearing aid apparatus is shown.

The processor unit 30 is construed as a filter bank with a number of band-pass filters, e.g. in parallel structure, and acting preferably each predominantly in one of the critical frequency bands or realized as a Fast-Fourier transform unit. Attention is drawn to the EP-0 661 909, especially to FIGS. 12*a* to 16, and the respective description with respect to such filter bank provided for loudness correction on an individual "I" to which, via output transducer 5, loudness corrected acoustical signals are transmitted.

At the output A of processor unit 30 calculating unit 70*a* calculates, according to a loudness model selected, the loudness $L_I(S, P_I)$ which the individual "I" will perceive and as corrected by the processor unit 30 of the hearing aid. The model parameters $P_I$ of the individual are entered into unit 70*a*, for instance the parameters according to the Leijon-model, whereabout the EP 0 661 905 or S. Launer (see above) shall be considered as integral part of the present application. We draw especially the attention to FIG. 15 as well as to FIGS. 3 to 9 and the according description of EP-0 661 905.

Similarly, the signal input to the processor unit 30 is led to a calculating unit 70*b* which may be implied at the same hardware unit as unit 70*a* and may in fact be the same unit. There, standard (N) loudness $L_N(S, P_N)$ of the incoming signal S is calculated according to standard parameters $P_N$ as also described in the EP-0 661 905 and in Launer which, here too, shall be considered as integral parts of the present description. The output signal of the calculating units 70*b*, 70*a* respectively representing loudness $I_N$ and $L_I$ are operationally connected to a control unit 72 wherein the two loudness values are compared. The control unit 72 which acts with its outputs on the control inputs $E_{30}$ which control the loudness-relevant parameters $P_{30}$ at the processor unit 30, i.e. at the respective filters of the filter bank incorporated therein. The perceived and calculated actual loudness $L_I$ is compared as a signal time-varying value at comparing unit 90 with the MAL-value output from storage 110. The comparison result, i.e. the output of the comparator unit 90, acts on an encoder unit 112 which generates a number of output signals led to weighting unit 114 whereat the parameter values emitted from control unit 72 to adjust the transfer function of unit 30 are further adjusted, thereby preventing $L_I$ to increase over MAL.

Figure 3:
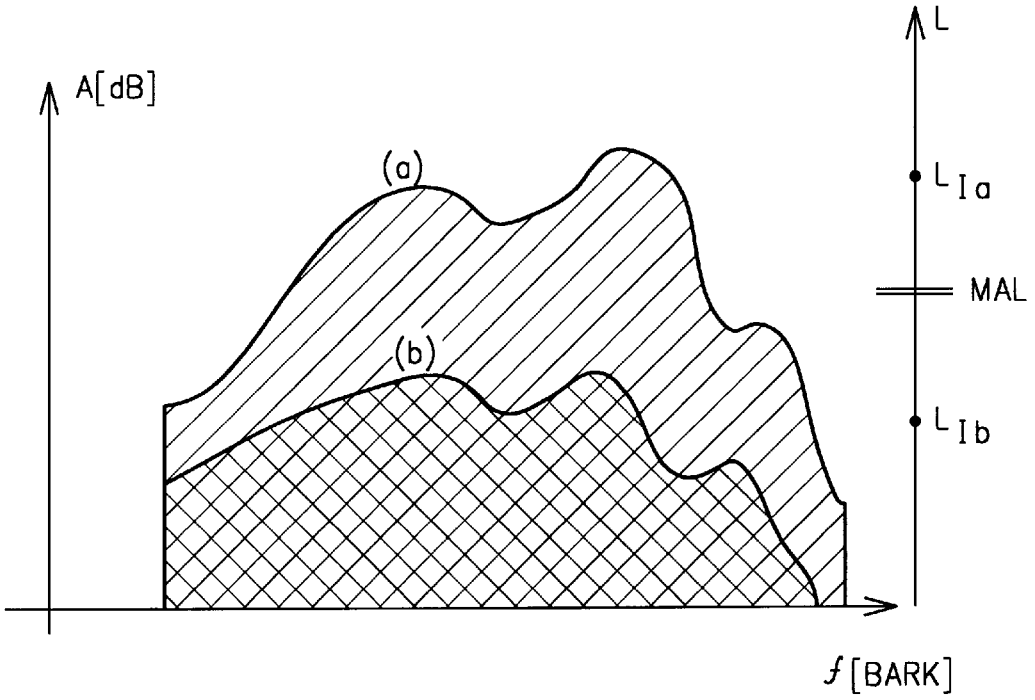

In FIG. 3 the spectrum a) of a signal A output from the processor unit 30 is shown over frequency e.g. scaled in Barks. The spectrum a) leads to loudness $L_{Ia}$ as represented by the area which is shaded under spectrum a) well above the MAL-value.

By the invention according to FIG. 1 or 2, this is detected and the transfer function of unit 30 is adjusted, e.g. to result in a signal A according to characteristic b) which now and according to the hatched surface area below characteristic b) accords with a loudness $L_{Ib}$ well below MAL.

By the present invention the signal transferred to the human ear is limited according to psychoacoustical loudness per ception of the human ear and not by preselecting any physical limit values.

What is claimed is:

1. A method for limiting a signal transmitted to a human ear in dependence on an incoming acoustical signal, comprising the steps of:

providing a limiting hearing apparatus, said apparatus generating, from an input acoustical signal (S), a signal (A) transmitted to the human ear with a controllable transfer characteristic;

storing a threshold value (MAL) in said apparatus;

generating a signal dependent on loudness of said transmitted signal ($L(S,P)$; $L_I(S,P_I)$) in said apparatus;

reducing loudness of said transmitted signal (A) by adjusting parameters of said transfer characteristic which determine the loudness ($L$; $L_I$) of said signal (A) transmitted to the ear as soon as said signal dependent on loudness ($L$; $L_I$) of said transmitted signal (A) reaches said threshold value (MAL)

calculating loudness ($L_N(S,P_N)$ as perceived by a standard on an acoustical signal (S) input to said apparatus;

calculating loudness ($L_I(S,P_I)$) as perceived by an individual on said acoustical signal and dependent on loudness of said transmitted signal (A);

calculating a desired hearing aid transfer characteristic from said calculated loudnesses of standard and individual;

adjusting said transfer characteristic (T) of said hearing apparatus according to said desired transfer characteristic;

performing said limiting by additionally adjusting said desired transfer characteristic in dependence on said loudness of said transmitted signal (A) and said threshold value (MAL).

2. The method of claim 1, wherein said limiting hearing apparatus is incorporated into a hearing aid apparatus.

3. A hearing apparatus, comprising an input acoustical/electric transducer (1), a signal processor unit (3; 30) with a controllable transfer characteristic (T), an input of said processor unit being operationally connected to an output of said input acoustical/electric transducer;

an output transducer (5) for the human ear, an input of said output transducer being operationally connected to an output of said processor unit;

a presettable storing unit (11; 110);

a first calculating unit (7; 70*a*), the input thereof being operationally connected to the output of said processor unit (3, 30) and generating an output signal which is dependent on loudness of an acoustical signal represented by said signal at the input of said output transducer (5), whereby the outputs of said first calculating unit (7; 70*a*) and said presettable unit (11; 110) are operationally connected to respective inputs of a comparing unit (9; 72);

an output of said comparing unit (9; 72) is operationally connected to adjusting inputs ($E_3$; $E_{30}$) for said characteristic of said processor unit (3; 30).

4. The apparatus of claim 3, wherein said transducers (1, 5) and said processor unit (3; 30) are part of a hearing aid apparatus.

5. The apparatus of claim, further comprising a second calculating unit (70*b*), an input of said second calculating unit being operationally connected to the output of said input transducer (1) and generating an output signal representing a standard loudness of an acoustical signal input to said input transducer (1);

the outputs of said first and second calculating units (70*a*, 70*b*) being operationally connected to a third calculating unit (72);

the output of said third calculating unit (72) being operationally connected to said adjusting inputs ($E_{30}$).

6. The apparatus according to any of claims 3 to 5, wherein said processor unit (3; 30) comprises a predetermined number of band-pass filters, each of said filters predominantly acting in a respective spectral band, said adjusting inputs ($E_3$; $E_{30}$) being operationally connected to adjusting inputs of said filters.

* * * * *

UNITED STATES PATENT AND TRADEMARK OFFICE

CERTIFICATE OF CORRECTION

PATENT NO. : 6,108,431

DATED : August 22, 2000

INVENTOR(S) : Bachler

It is certified that error appears in the above-indentified patent and that said Letters Patent is hereby corrected as shown below:

Column 1, line 9, delete "on" and insert --an--.

Column 1, line 51, delete "summer" and insert --summed--

Column 3, line 16, delete "invention" (second occurrrence) and insert --inventive--.

Column 3, line 19, delete "invention" and insert --inventive--.

Column 3, line 25, delete "invention" and insert --inventive--.

Column 4, line 3, delete "$R_3$" and insert --$E_3$--.

Column 6, line 64, delete "$I_N$" and insert --$L_N$--.

Column 6, Claim 5, line 1, after "claim" insert --4--.

Signed and Sealed this

Twenty-fourth Day of April, 2001

*Attest:*

*Attesting Officer*

Nicholas P. Godici

NICHOLAS P. GODICI

*Acting Director of the United States Patent and Trademark Office*